US006005345A

United States Patent [19]

Choi et al.

[11] Patent Number: 6,005,345

[45] Date of Patent: Dec. 21, 1999

[54] PLASMA DISPLAY PANEL AND METHOD OF FABRICATING THE SAME

[75] Inventors: Nak-Heon Choi; Do-Young Ok; Jin-Man Kim, all of Kyoungki-do; Deuk-Soo Pyun, Seoul, all of Rep. of Korea

[73] Assignee: Hyundai Electronics Industries Co., Ltd., Kyoungki-do, Rep. of Korea

[21] Appl. No.: 08/844,584

[22] Filed: Apr. 21, 1997

[30] Foreign Application Priority Data

May 22, 1996 [KR] Rep. of Korea ..... 96-17388

[51] Int. Cl.[6] ..... H01J 61/067

[52] U.S. Cl. ..... 313/582; 313/584

[58] Field of Search ..... 313/582, 583, 313/584, 590, 609

[56] References Cited

U.S. PATENT DOCUMENTS

| | | | |
|---|---|---|---|
| 4,896,149 | 1/1990 | Buzak et al. | 340/794 |
| 5,107,176 | 4/1992 | Endo et al. | 313/583 |
| 5,247,227 | 9/1993 | Park | 313/584 |
| 5,349,455 | 9/1994 | Hayashi et al. | 359/54 |
| 5,764,001 | 6/1998 | Khan et al. | 313/582 |
| 5,777,436 | 7/1998 | Lepselter | 313/582 |

FOREIGN PATENT DOCUMENTS 8511126 11/1996 Japan .

*Primary Examiner*—Vip Pator
*Assistant Examiner*—Matthew J Gerike
*Attorney, Agent, or Firm*—Ware, Fressola, Van Der Sluys & Adolphson LLP

[57] ABSTRACT

A plasma display panel is disclosed including a transparent insulating substrate having a plurality of striped grooves, whose portions between the grooves serve as barrier ribs; vertical transparent electrodes each of which is formed in each groove; a fluorescent layer formed on the vertical transparent electrode; horizontal electrodes in strip arrangement having a predetermined distance between one another, and being perpendicular to the transparent vertical electrodes; and supporting means which are respectively located on the edge portions of the substrate for supporting the horizontal electrodes.

3 Claims, 3 Drawing Sheets

PLASMA DISPLAY PANEL AND METHOD OF FABRICATING THE SAME

BACKGROUND OF THE INVENTION

1. Field of the Invention

The present invention relates to a plasma display panel, specifically, to a plasma display panel in which a barrier rib is formed from its substrate, and a method of fabricating the same.

2. Discussion of Related Art

FIG. 1 shows a cross-sectional view of a conventional plasma display panel. Referring to FIG. 1, a plasma display panel, which displays pictures using gas discharge, includes two flat panels, a front substrate 1 and a back substrate 2, respectively. The edge portions of the substrates are sealed, and a large amount of gas is contained between the two substrates having a predetermined distance therebetween. Anodes 3 are formed on the inner surface of the front substrate 1 and cathodes 4 are formed on the inner surface of the back substrate 2. The anodes 3 and cathodes 4 are formed in a strip arrangement, and arranged in perpendicular fashion to each other. Barrier ribs 5 are formed on the front substrate 1 between anodes 3, to define the pixels of a plasma display and prevent crosstalk between neighboring pixels.

The resolution of the aforementioned plasma display panel depends on the inner structure between the front and back substrates, the kind of gas contained between the substrates, the shape and material of the cathode, and the degree of flatness of the barrier rib's surface coming into contact with the front substrate. In particular, the degree of flatness of the barrier rib's surface is crucial, because the barrier rib prevents the diffusion of light between neighboring pixels when they are discharged during the operation of the display panel.

Methods of forming the barrier rib include a screen printing method, a transfer method, and a sand blasting method.

With the screen printing method, a substrate is covered by a mask, a mucous material is then coated thereon and a burning process is carried out, to thereby form the barrier rib. The screen printing may be performed several times in order to control the height of the barrier rib. It is, however, difficult to form the barrier rib with great accuracy over a wide panel using the screen printing method because the mesh used in forming the mask can be warped.

In case of the transfer method, a mask pattern is formed on a substrate, and a material used for barrier ribs is continuously coated on the pattern, to thus form the barrier ribs. This method cannot be applied in the manufacture of SVGA HDTV display panel due to limits in pattern resolution.

With the sand blasting method, a material for barrier rib is uniformly coated on a substrate, and a protective layer acting as a mask is then formed on the barrier rib material. Next, the exposed portions of the barrier rib material are removed using a sand blaster and the protective layer is afterwards removed to thus form the barrier ribs. In this method, however, as the hard small grains used by the sand blaster strongly collide with the barrier rib material in order to cut the unnecessary portions, the small grains also strongly collide against the protective layer with such a force that portions of the protective layer are displaced against the surface of the barrier rib causing damage. Thus, a uniform surface of the barrier ribs is not obtained.

Accordingly, for the purpose of easily cutting the portions without damaging the protective layer or anode and cathode electrodes, new electrode material and protective layer material needs to be developed.

SUMMARY OF THE INVENTION

Accordingly, the present invention is directed to a plasma display panel and a method of fabricating the same that substantially obviates one or more of the problems due to limitations and disadvantages of the related art.

An object of the present invention is to provide a plasma display panel and a method of fabricating the same, which forms dense and uniform barrier ribs.

To accomplish the object of the present invention, there is provided a method of fabricating a plasma display panel including the steps of: preparing a transparent insulating substrate having a plurality of grooves in strip arrangement; sequentially forming a transparent electrode, red, green and blue fluorescent layers on each of the grooves; forming a sacrificial layer on the overall surface of the substrate by a predetermined thickness; forming a through hole on the marginal portion of the substrate which has a predetermined distance from the transparent electrode, the through hole exposing a portion of the transparent insulating substrate; depositing an electrode material on the overall surface of the sacrificial layer including the through hole so as to bury the through hole; selectively etching the electrode material layer so as to form an electrode perpendicular to the transparent electrode, the electrode including the electrode material portion buried in the through hole; and removing the sacrificial layer.

The present invention provides a plasma display panel including: a transparent insulating substrate having a plurality of grooves in strip arrangement, whose portions between the grooves serve as barrier ribs; vertical transparent electrodes each of which is formed in each groove; a fluorescent layer formed on the vertical transparent electrode; horizontal electrodes in strip arrangement having a predetermined distance therebetween, and being perpendicular to the transparent vertical electrodes; and supporting means which are respectively located on the edge portions of the substrate for supporting the horizontal electrode.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENT

Figure 1:
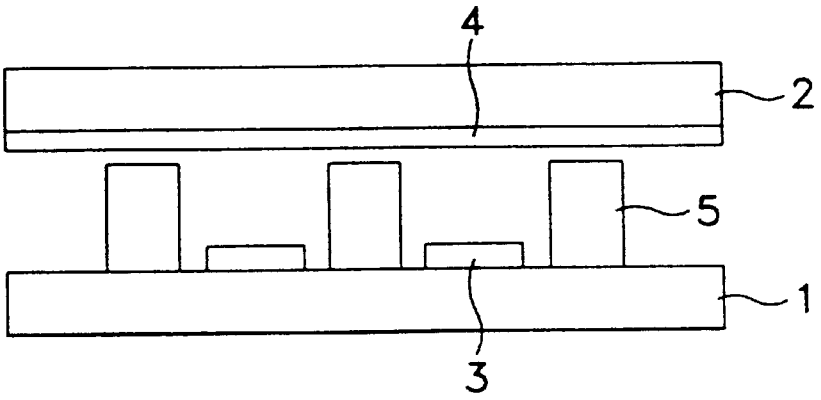
FIG. 1 PRIOR ART
FIG. 1 is a cross-sectional view of a conventional plasma display panel.
Figure 2A:
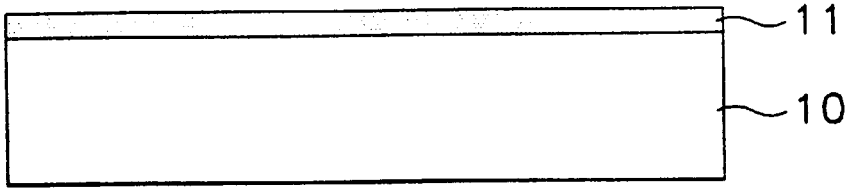
FIGS. 2A to 2F are cross-sectional views showing a method of fabricating a plasma display panel according to the present invention.
Figure 2B:
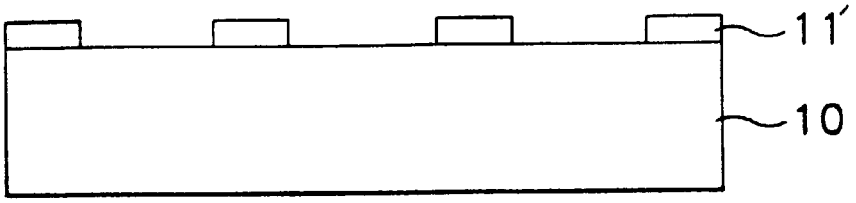

Referring to FIG. 2A, in the preparation to fabricate a plasma display panel, there is provided a top transparent insulating substrate (not shown) and a bottom or front transparent insulating substrate 10'. The transparent insulating substrates can be a glass substrate. A photoresist layer 11 is coated to a predetermined thickness on the transparent substrate 10. Referring to FIG. 2B, photoresist layer 11 is selectively exposed and developed through a conventional photolithography process, to form a photoresist pattern 11'.

Figure 2C:
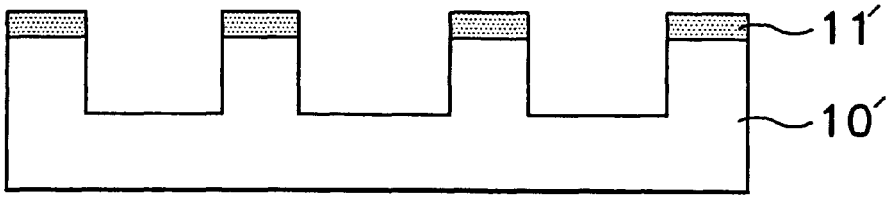
Figure 2D:
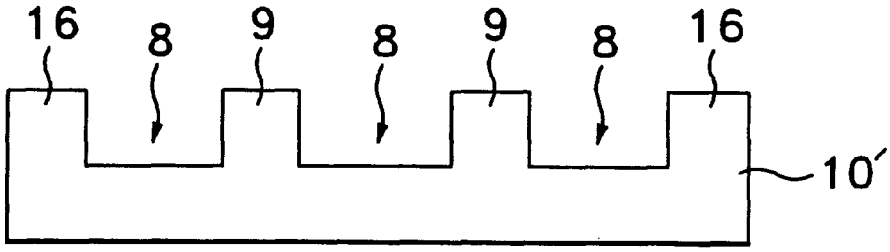
Figure 2E:
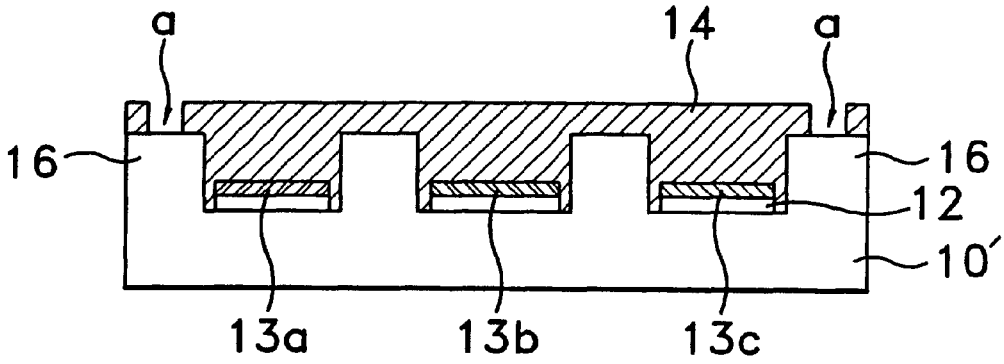

Referring to FIG. 2C, an exposed portion of substrate 10 is selectively etched to a predetermined depth using photoresist pattern 11' as a mask. A dry etching using plasma is preferable as the etching method. Referring to FIG. 2D, photoresist pattern 11' is removed resulting in barrier ribs being formed in substrate 10'. Referring to FIG. 2E, a transparent conductive material like indium tin oxide (ITO) is deposited on the overall surface of substrate 10 including the barrier ribs, and selectively etched through photolithography using a predetermined photoresist mask (not shown), to thereby form vertical transparent electrodes, that is, anodes 12.

Thereafter, a red fluorescent material is coated on the overall surface of the substrate, and selectively etched through photolithography, to form a red fluorescent layer 13*a* on a predetermined anode 12. Through the same method, green and blue fluorescent layers 13*b* and 13*c* are sequentially formed on the remaining anodes. In order to obtain a discharge space in a pixel defined by the barrier ribs, a sacrificial layer 14 of polyimide is formed to a predetermined thickness on the overall surface of the substrate, and selectively etched so as to expose the surface of the barrier ribs placed on the marginal portion of the substrate, to thereby form a through hole (a). The through hole (a) is where a horizontal electrode, which will be formed in the following process, and substrate 10' are to come into contact with each other.

Figure 2F:
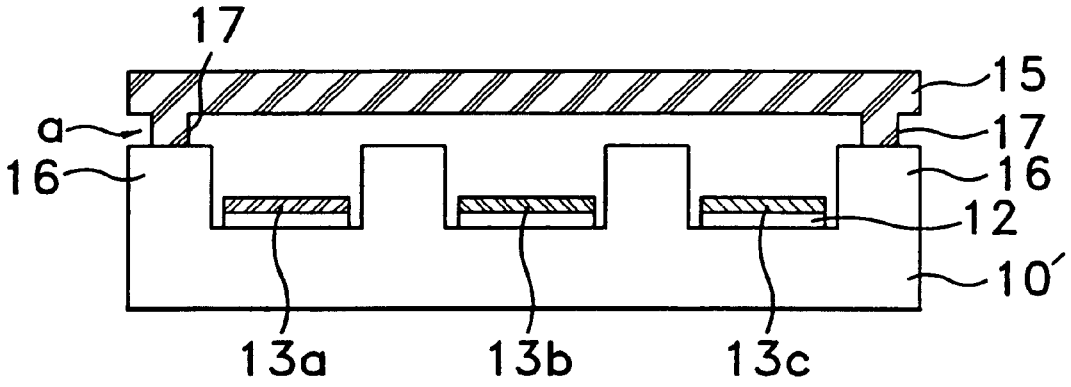

Referring to FIG. 2F, a conductive material such as aluminum is deposited on sacrificial layer 14 including through hole (a), and patterned through a conventional photolithography, to thereby form a striped horizontal electrode (cathode) 15 perpendicular to vertical transparent electrode (anode) 12. A conductive material filled in through holes (a) forms supports 17 that contribute in supporting each horizontal electrode. Thereafter, sacrificial layer 14 is removed through a wet etching, to thereby form a gas discharge space between the vertical and horizontal electrodes. As a result, a bottom panel of the plasma display panel is formed.

Figure 3:
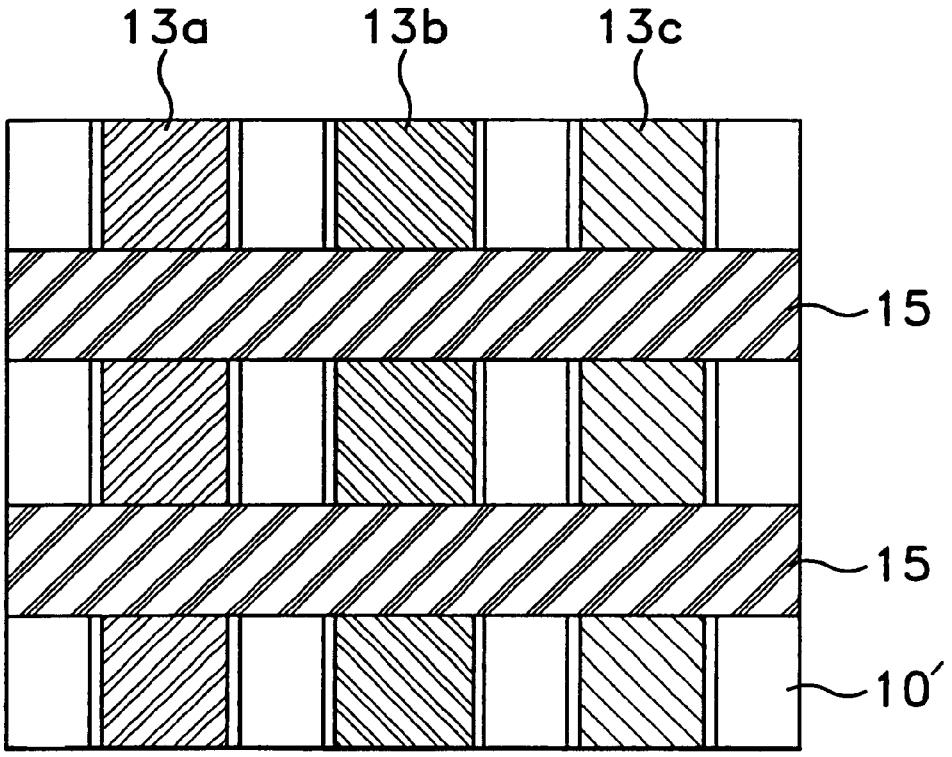
FIG. 3 is a plan view of the plasma display panel formed through the method shown in FIGS. 2A to 2F.

FIG. 3 is a plan view of the structure shown in FIG. 2F. Referring to FIG. 3, the plasma display panel of the present invention is constructed in such a manner that the vertical transparent electrode 12 and fluorescent layers 13*a*, 13*b* and 13*c* are located between the barrier ribs that are formed through etching of the substrate. The horizontal electrodes 15 intersect the vertical electrodes 12 having a predetermined distance therebetween, and gas discharge space is provided between horizontal electrodes 15 and fluorescent layers 13*a*, 13*b* and 13*c*.

The top transparent substrate (not shown), covers the bottom panel including the flat barrier ribs, and the edge portions of which are sealed with the edge portions of the bottom substrate 10.

According to the present invention, since the bottom substrate is selectively etched so as to form the barrier ribs, the barrier ribs having flat surfaces can be obtained. Thus, the crosstalk between pixels discharged is removed. Accordingly, during the operation of the display panel, the diffusion of light between neighboring pixels is also prevented.

Furthermore, pitch size of the pixel can be decreased, resulting in an improvement of the resolution of picture displayed by the plasma display panel.

Although the preferred embodiment of the present invention has been disclosed for illustrative purposes, those skilled in the art will appreciate that various modifications, additions and substitutions are possible, without departing from the scope and spirit of the present invention as disclosed in the accompanying claims.

What is claimed is:

1. A plasma display panel having front and back substrates with a discharge gas therebetween wherein said front substrate comprises:

a transparent insulating substrate (10') having edge portions (16), a plurality of grooves (8) in a strip arrangement between the edge portions (16), and portions existing between the grooves serving as barrier ribs (9);

vertical transparent electrodes (12) each of which is formed in each groove (8);

a fluorescent layer (13*a–c*) formed on the vertical transparent electrodes;

horizontal electrodes (15) in strips arrangement having a distance therebetween, and being perpendicular to the transparent vertical electrodes (13*a–c*); and supporting means (17) located on the edge portions of the substrate for supporting the horizontal electrodes (15).

2. The plasma display panel as claimed in claim 1, wherein the horizontal electrode and supporting means are formed of an identical material.

3. The plasma display panel as claimed in claim 2, wherein the material is aluminum.

* * * * *